United States Patent [19]

Yamada

[11] Patent Number: 4,546,935

[45] Date of Patent: Oct. 15, 1985

[54] METHOD OF AND APPARATUS FOR PILING UP TAPES

[75] Inventor: Yasuo Yamada, Kurobe, Japan

[73] Assignee: Yoshida Kogyo K. K., Tokyo, Japan

[21] Appl. No.: 508,877

[22] Filed: Jun. 28, 1983

[30] Foreign Application Priority Data

Jun. 29, 1982 [JP] Japan ..... 57-112198

[51] Int. Cl.[4] ..... B65H 55/00; B65H 55/04

[52] U.S. Cl. ..... 242/170; 242/174

[58] Field of Search ..... 242/82, 166, 167, 170, 242/174; 226/190, 194, 181, 188, 118; 28/125–131; 140/70 C, 65, 92.2–92.94

[56] References Cited

U.S. PATENT DOCUMENTS 3,478,399 11/1969 Wyatt et al. ..... 242/82 X 4,313,550 2/1982 Van Gorp ..... 226/194

*Primary Examiner*—Leonard D. Christian

*Attorney, Agent, or Firm*—Hill, Van Santen, Steadman & Simpson

[57] ABSTRACT

Elongate materials such as slide fastener stringer tapes are discharged in circular motions into a storage container by a tape guide pipe guided by a pipe guide rotatable in composite circular motions along successive first circular paths while revolving along a second circular path. The elongate materials thus discharged are piled up in an orderly manner in the storage container so that they can be picked up at a later time without being entangled with each other. The pipe guide may be rotated in the composite circular motions by a link mechanism, a gear-turntable assembly, or a planetary gear assembly.

13 Claims, 6 Drawing Figures

METHOD OF AND APPARATUS FOR PILING UP TAPES

BACKGROUND OF THE INVENTION

1. Field of the Invention

The present invention relates to a method of and an apparatus for piling up elongate materials such as slide fastener stringer tapes in a storage container.

2. Description of the Prior Art

It has been general practice to stack a multiplicity of fabricated tapes or other ribbon-shaped webs randomly in a storage container through a vertically movable discharger. When tapes are to be picked up from the tape pile for a next processing step, however, they tend to be entangled with lower tapes and the entangled tapes are liable to come out of the container.

SUMMARY OF THE INVENTION

It is an object of the present invention to provide a method of and an apparatus for piling up elongate materials such as fabric tapes in an orderly manner in a storage container so that the elongate materials can be picked up from the container smoothly without their turns being entangled together.

According to the present invention, elongate materials such as tapes are discharged in circular motions into a storage container by a tape guide pipe guided by a pipe guide rotatable in composite circular motions along successive first circular paths while revolving along a second circular path. The elongate materials thus discharged are piled up in an orderly manner in the storage container so that they can be picked up at a later time without being entangled with each other. The pipe guide may be rotated in the composite circular motions by a link mechanism, a gear-turntable assembly, or a planetary gear assembly.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
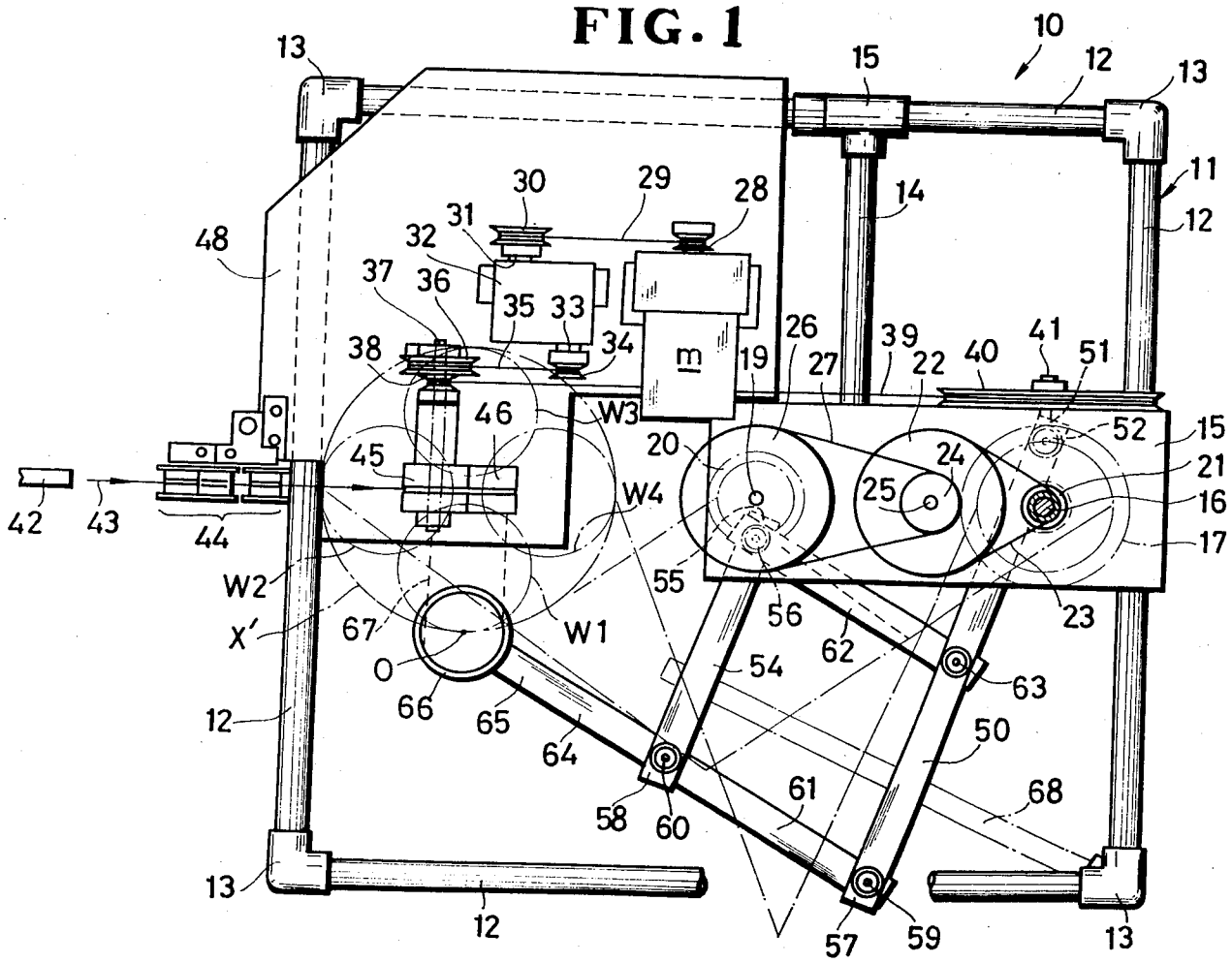
FIG. 1 is a plan view, partly broken away, of an apparatus for piling up elongate materials according to the present invention.
Figure 2:
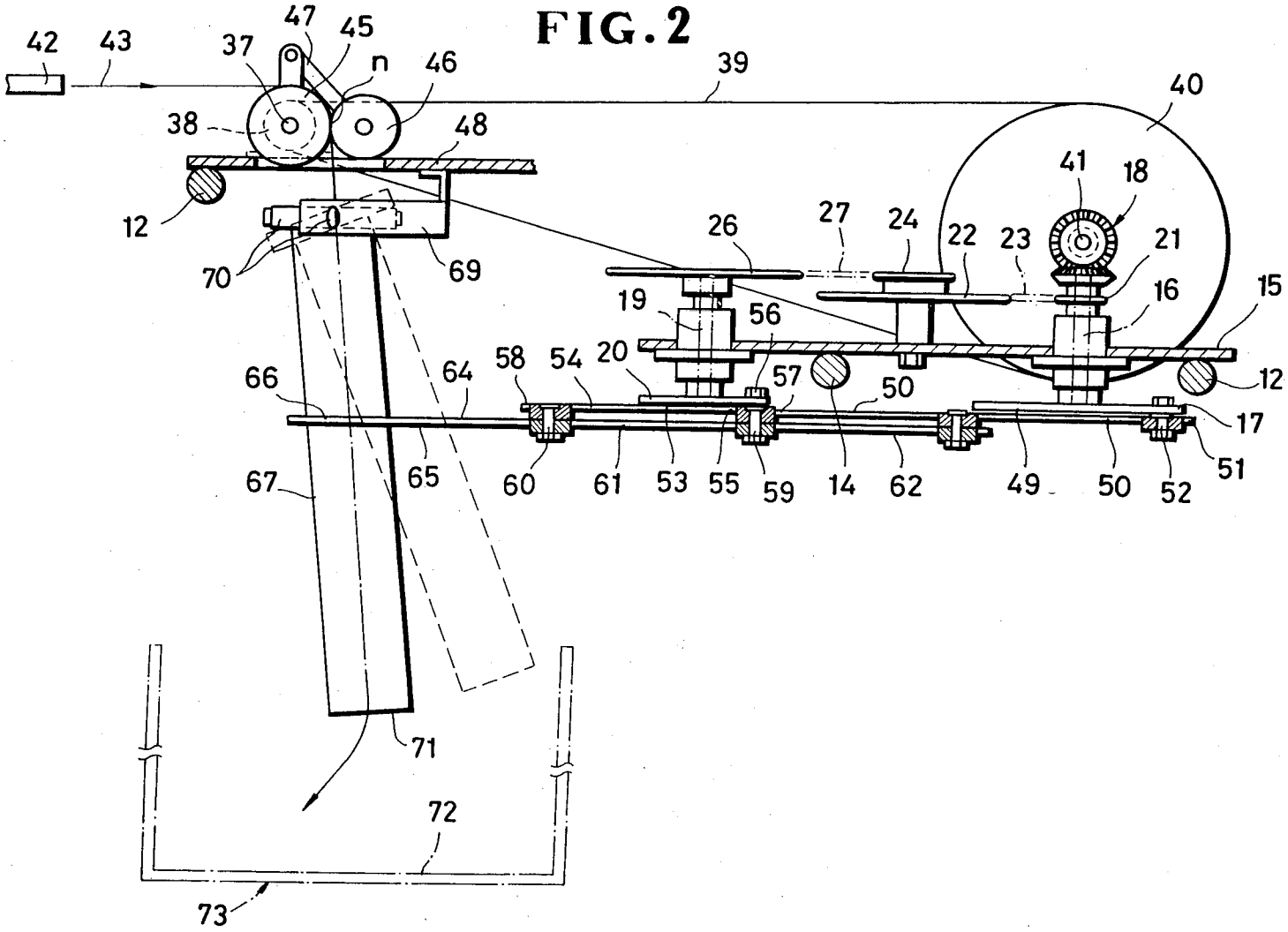
FIG. 2 is a side elevational view, with parts in cross section and cut away, of the apparatus shown in FIG. 1.

As shown in FIGS. 1 and 2, an apparatus 10 according to the present invention comprises a frame 11 composed of frame members 12 interconnected by elbow joints 13 and a frame member 14 connected by a tee-joint 15 to one of the frame members 12. A base plate 15 is mounted on one of the frame members 12 and the frame member 14 and supports a shaft 16 rotatably thereon the shaft 16 corotatably supporting a first crank disk 17. The shaft 16 can be positively rotated by a drive motor m (FIG. 1) as described below. A shaft 19 is also rotatably mounted on the base plate 15 and corotatably supports thereon a second crank disk 20.

The shaft 19 is rotatable at a reduced speed by the shaft 16 through a sprocket wheel 21 mounted on the shaft 16, a sprocket wheel 22 rotatably mounted on the base plate 15, a chain 23 trained around the sprocket wheels 21, 22, a sprocket wheel 24 corotatable with the sprocket wheel 22, a sprocket wheel 26 mounted corotatably on the shaft 19, and a chain 27 trained around the sprocket wheels 24, 26. Though the ratio of speed reduction may be selected as desired, it is set up as 1/11.4 in the illustrated embodiment so that the shaft 19 makes one revolution about its own axis when the shaft 16 makes 11.4 revolutions.

The drive motor m is operatively coupled to a speed reducer 32 through a pulley 28 of the drive motor m, a belt 29, and a pulley 30 mounted on an input shaft 31 of the speed reducer 32. The speed reducer 32 has an output shaft 33 supporting thereon a pulley 34 operatively connected by a belt 35 to a pulley 36 mounted on a drive shaft 37. The drive shaft 37 supports thereon a pulley 38 operatively connected by a belt 39 to a pulley 40 mounted on a shaft 41. The shaft 41 and the shaft 16 are operatively interconnected by a bevel gearing 18 as illustrated in FIG. 2. Therefore, the first and second crank disks 17, 20 are rotatable at reduced speeds by the drive motor m.

An elongate material 42 such as a slide fastener stringer tape is fed along a path 43 through a group of tensioning rolls 44 to a discharge roll 45 mounted on the drive shaft 37. The tape 42 is discharged downwardly (as shown in FIG. 2) by the discharge roll 45 and a presser roll 46 held thereagainst by an arm 47.

The drive motor m, the speed reducer 32, the drive shaft 37, the tensioning rolls 44, the discharge roll 45, and the presser roll 46 are mounted on a support table 48 mounted on two adjacent ones of the frame members 12.

A first link 50 has one end 51 rotatably connected by a crank pin 52 to a lower end face 49 of the first crank disk 17. A second link 54 has one end 55 rotatably connected by a crank pin 56 to a lower end face 53 of the second crank disk 20. The first and second links 50, 54 have opposite ends 57, 58, respectively, pivotably coupled by pins 59, 60 to a third link 61. The first and second links 50, 54 are also pivotably coupled to a fourth link 62 by a pin 63 and the crank pin 56. The third link 61 has an extension 64 serving as a guide bar having an annular pipe guide 66 on its distal end 65. A tape guide pipe 67 (described later on) is fitted in the annular pipe guide 66. The first and second links 50, 54 are slidably supported on a support rod 68 fixed to the frame 11.

The crank pin 52 and the pin 59 are spaced from each other by a distance equal to the distance between the pin 59 and a center O of the pipe guide 66. The crank pin 56 and the pin 60 are spaced from each other by a distance equal to the distance between the crank pin 56 and the pin 63.

As illustrated in FIG. 2, the tape 42 is nipped at a point n between the discharge roll 45 and the presser roll 46. Below the nipping point n, the tape guide pipe 67 extending through the annular pipe guide 66, depends from a universal joint or gimbal 70 operatively mounted on a bracket 69 affixed to the support table 48. The tape guide pipe 67 has a lower open end 71 directed toward the bottom 72 of a storage container 73 disposed below the tape guide pipe 67.

Figure 3:
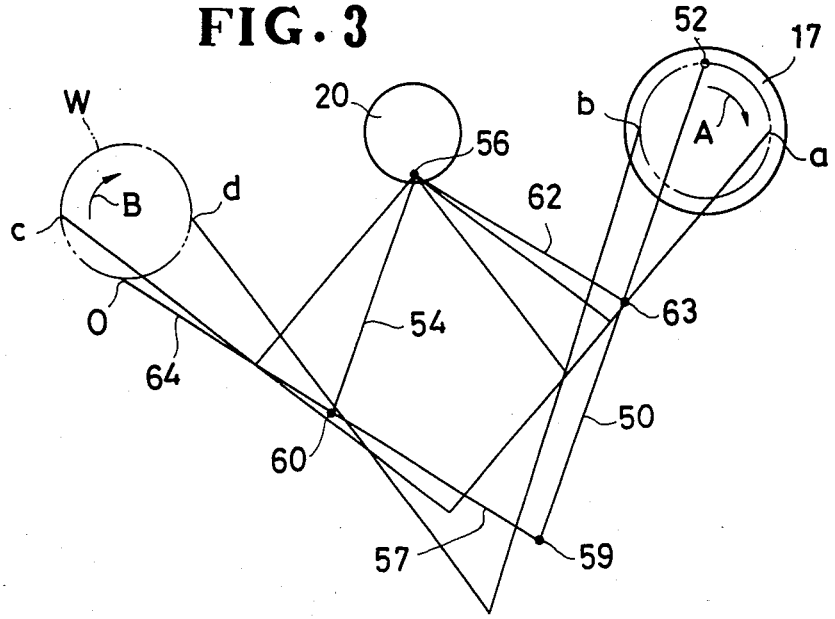
FIGS. 3 and 4 are schematic diagrams showing the principles of operation of the apparatus of FIG. 1.

Operation of the apparatus of the foregoing construction is as follows:

When the second crank disk 20 is fixed with the crank pin 56 stopped in the position shown in FIG. 3 and the first crank disk 17 is rotated 360° in the direction of the arrow A, the crank pin 52 revolves successively through points a, b. The center O of the pipe guide 66 then revolves successively through points c, d along a first circular path W.

Figure 4:
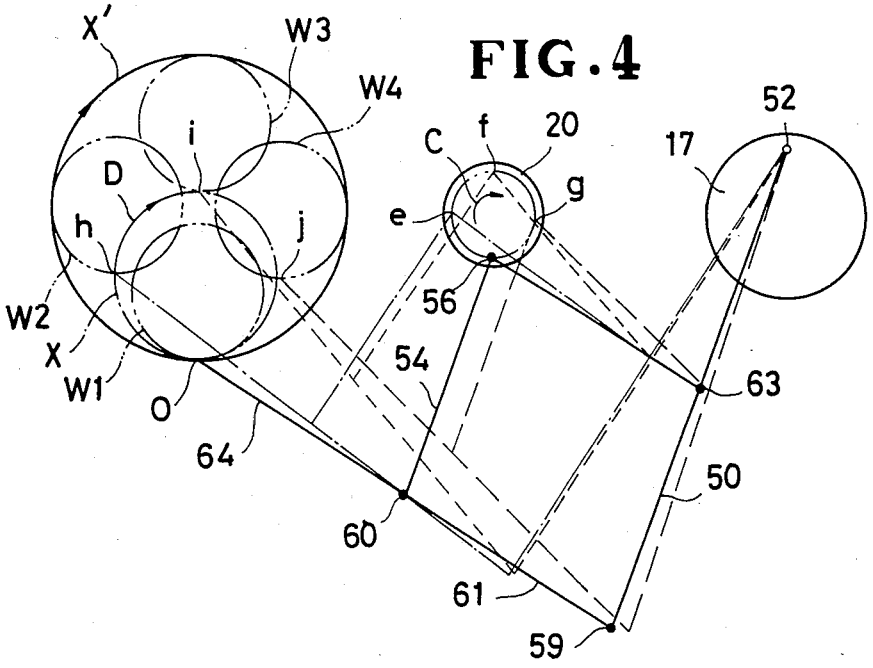

When the first crank disk 17 is fixed with the crank pin 52 stopped in the position shown in FIG. 4 and the second crank disk 20 is rotated 360° in the direction of the arrow C, the crank pin 56 travels successively through points e, f, g. The center O of the pipe guide 66 then angularly moves successively through points h, i, j while following a second circular path X.

In the illustrated embodiment, the second crank disk 20 makes one revolution while the first crank disk 17 makes 11.4 revolutions. Combination of the movements shown in FIGS. 3 and 4 enables the center O of the pipe guide 66 to describe first circular paths W1, W2, W3, W4, for example, successively while travling along the second circular path X. As a consequence, the center O of the pipe guide 50 moves in a path inscribed in a larger circle X' while following the first circular paths W1 through W4.

Since the tape guide pipe 67 is freely pivotably movable by the universal joint 70, the lower open end 71 of the tape guide pipe 67 is circularly moved in a pattern similar to that of circular movements of the pipe guide 66 in response to the composite movements of the latter along the first circular paths W1–W4 and the second circular path X. Tapes discharged by the discharge roll 45 and the presser roll 46 are introduced into the tape guide pipe 67 and are then successively piled onto the bottom 72 of the storage container 73 while following the movements along the first circular paths W1–W4 and the second circular path X.

The ratio of the speed of the shaft 19 to the speed of the shaft 16 is selected preferably not to be an integer such, for example 1/11.4, as in the illustrated embodiment, in order to prevent tapes from being stacked one on the other in successive circular motions of the tape guide pipe 67. However, the speed reduction ratio may be selected otherwise provided the shaft 19 makes a plurality of revolutions while the shaft 16 makes a single revolution.

Where the tape guide pipe 67 is of a diameter larger than the width of the tapes to be discharged therethrough, the tapes can move around freely in the tape guide pipe 67 so that the tapes as they are caused to face in a certain direction by the rolls 45, 46 will be prevented from being reversed while the tape guide pipe 67 is in a circular motion. Therefore, the tapes are successively stacked while facing in one direction in the storage container 73 without a tendency to become twisted due to the tapes' being discharged in circular motion.

Figure 5:
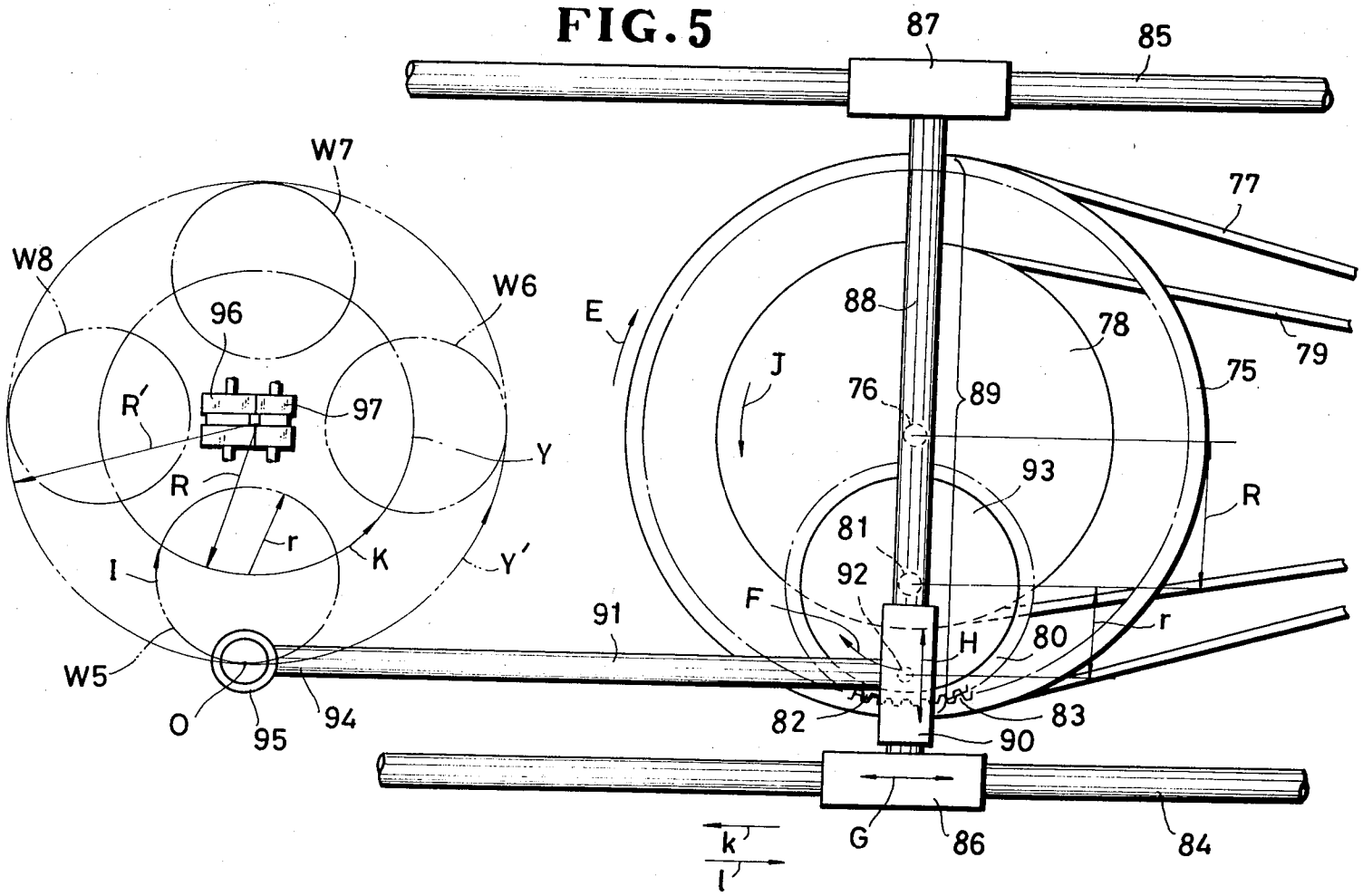
FIG. 5 is a fragmentary plan view of another embodiment of the present invention.
Figure 6:
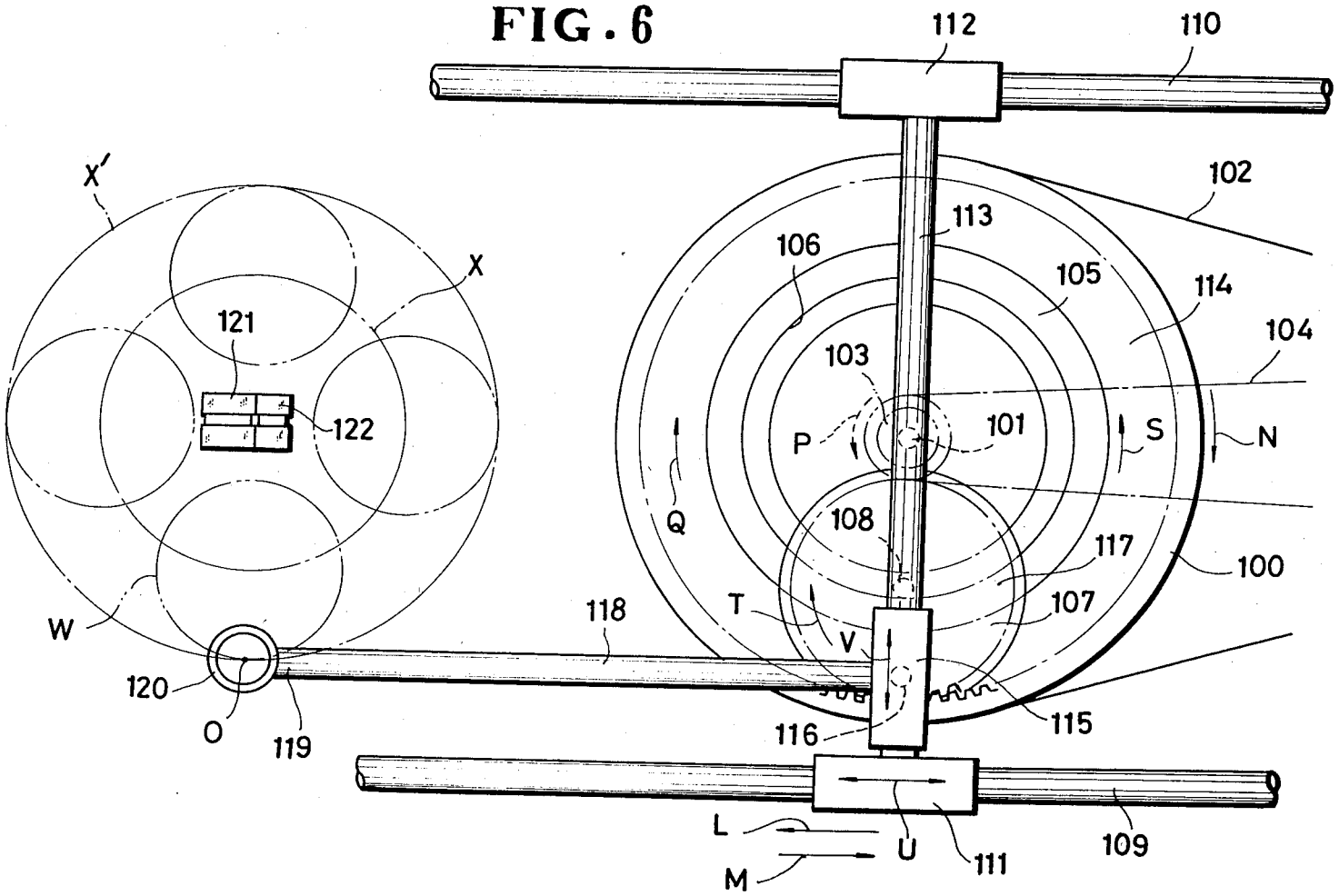
FIG. 6 is a fragmentary plan view of still another embodiment of the present invention.

FIG. 5 shows an apparatus for piling up elongate materials according to another embodiment of the present invention. An internal gear 75 is rotatably mounted by a shaft 76 on a machine base (not shown), the internal gear 75 being positively drivable by a belt 77 trained therearound and around a drive pulley (not shown). A turntable 78 is also rotatably mounted on the shaft 76 concentrically with the internal gear 75. The turntable 78 is positively drivable by a belt 79 trained therearound and around another drive pulley (not shown). The turntable 78 supports thereon an external gear 80 rotatably mounted by a shaft 81 off center on the turntable 78. The external gear 80 has teeth 82 held in mesh with teeth 83 of the internal gear 75.

The apparatus also includes a pair of first and second parallel guide bars 84, 85 fixed to the machine frame and carrying a pair of sliders 86, 87, respectively, slidably thereon. A third guide bar 88 is attached at ends thereof to the sliders 86, 87, respectively, and extends perpendicularly to the first and second parallel guide bars 84, 85. The third guide bar 88 is reciprocably movable in the directions of the arrows k, l along the first and second parallel guide bars 84, 85 back and forth across an end face 89 of the internal gear 75.

A slider 90 is slidably mounted on the third guide bar 88 for movement back and forth along the third guide bar 88 in the directions of the arrow H. The slider 90 is rotatably attached by a pin 92 to an end face 93 of the external gear 80. To the slider 90, there is secured one end of a guide rod 91 having an opposite end 94 supporting an annular pipe guide 95 through which a tape guide pipe (not shown) similar to the tape guide pipe 67 shown in FIG. 2 extends vertically. The tape guide pipe is located substantially below a tape discharge roll 96 and a presser roll 97 for guiding tapes into the tape guide pipe.

The shafts 76, 81 are spaced from each other by a distance R, and the shaft 81 and the pin 92 are spaced from each other by a distance r. When the internal gear 75 is rotated by the belt 77 in the direction of the arrow E, the external gear 80 in mesh therewith is rotated in the direction of the arrow F for thereby causing the sliders 86, 87 to move in the directions of the arrow G and the slider 90 to move in the directions of the arrow H. At this time, the center O of the pipe guide 95 rotates in the direction of the arrow I along a first circular path W5 having a radius r. When the turntable 78 is also rotated by the belt 79 in the direction of the arrow J, the shaft 81 on the turntable 78 revolves in a circular motion causing the sliders 86, 87 and 90 to slide additionally in the directions of the arrows G, H. The center O of the pipe guide 95 then revolves around a second circular path Y having a radius R. While the turntable 78 makes one revolution, the internal gear 75 makes a plurality of revolutions.

As the internal gear 75 and the turntable 78 are in rotation, the center O of the guide pipe 95 revolves around the second circular path Y while successively following first circular paths W6, W7, W8, for example, which are inscribed in a circle Y' having a radius R' that is the sum of the radii R and r. The tape guide pipe guided by the pipe guide 95 then rotates in combined circular motions to pile up tapes in an orderly manner in a storage container.

With this arrangement, the center O of the pipe guide 95 can be rotated in as many revolutions as desired while revolving around the second circular path Y simply by changing the ratio of the RPM of the internal gear 75 to the RPM of the turntable 78.

According to still another embodiment of the present invention, a tape piling apparatus comprises a planetary gear assembly composed of an internal gear 100 rotatably mounted by a shaft 101 on a machine base (not shown) and positively drivable by a belt 102, a sun gear 103 rotatably mounted by the shaft 101 on the machine base and positively drivable by a belt 104, and a planet gear 107 held in mesh with the internal gear 100 and the sun gear 103 and having a central shaft 108.

A pair of first and second parallel guide bars 109, 110 is fixed to the machine base and supports a pair of sliders 111, 122, respectively, slidable therealong and interconnected by a third guide bar 113 extending perpendicularly to the first and second guide bars 109, 110. The third guide bar 113 is reciprocably movable with the sliders 111, 112 in the directions of the arrows L, M across an end face 114 of the internal gear 100. A slider 115 is slidably mounted on the third guide bar 113 for reciprocable movement therealong in the directions of the arrow V. The slider 115 is coupled to an end face 117 of the planet gear 107 by a pin 116 rotatably mounted on the planet gear 107 in eccentric relation thereto.

A guide rod 118 is secured at one end thereof to the slider 115 and supports at its opposite end 119 an annular pipe guide 120 through which a tape guide pipe (not shown) similar to the tape guide pipe 67 illustrated in FIG. 2 extends substantially below a tape discharge roll 121 and a presser roll 122 coacting therewith.

The shaft 108 of the planet gear 107 is guided in an annular slot 106 defined in an end face of a guide disk 105 fixed to the machine base.

When the internal gear 100 is rotated by the belt 102 in the direction of the arrow N and the sun gear 103 is rotated by the belt 104 in the direction of the arrow P at different peripheral speeds, the planet gear 107 revolves around the sun gear 103 in the direction of either the arrow Q or S while at the same time rotating about the shaft 108 in the direction of the arrow T. More specifically, when the internal gear 100 rotates at a peripheral speed greater than that of the sun gear 103, the planet gear 107 revolves around the sun gear 103 in the direction of the arrow Q. When the sun gear 103 rotates at a peripheral speed greater than that of the internal gear 100, the planet gear 107 revolves around the sun gear 103 in the direction of the arrow S.

As the planet gear 107 rotates about the shaft 108 and revolves around the sun gear 103, the sliders 111, 112 and 115 reciprocably move in the directions of the arrows U, V, respectively, to enable the center O of the pipe guide 120 to follow successive first circular paths W while moving around a second circular path X, the first circular paths W being inscribed in a larger circle X'. When the planet gear 107 revolves in the direction of the arrow Q, the center O of the pipe guide 120 revolves clockwise around the second circular path X. When the planet gear 107 revolves in the direction of the arrow S, the center O of the pipe guide 120 revolves counterclockwise around the second circular path X. The number of successive first circular paths followed by the center O of the pipe guide 120 while it revolves around the second circular path X can be varied by changing the ratio of the RPM of the internal gear 100 to the RPM of the sun gear 103.

Although various minor modifications may be suggested by those versed in the art, it should be understood that I wish to embody within the scope of the patent warranted hereon, all such embodiments as reasonably and properly come within the scope of my contribution to the art.

What is claimed is:

1. An apparatus for piling up elongate materials, comprising:

(a) a frame;

(b) a first crank disk positively rotatably mounted on said frame;

(c) a second crank disk positively rotatably mounted on said frame, said first crank disk being capable of making a plurality of revolutions per each revolution of said second crank disk;

(d) a first link having one end rotatably connected to said first crank disk;

(e) a second link having one end rotatably connected to said second crank disk;

(f) a third link angularly movably connected to opposite ends of said first and second links;

(g) a fourth link angularly movably connected to said first and second links;

(h) said third link having an extension serving as a guide bar having a distal end;

(i) a discharge roll rotatably mounted on said frame for discharging the elongate materials successively; and (j) a guide pipe universally movably supported on said frame below said discharge roll and guided by said distal end for piling up the elongate materials in composite circular motions when said first and second crank disks are rotated.

2. An apparatus according to claim 1, including a speed reducing sprocket wheel through which said second crank disk is operatively connected to and driven by said first crank disk.

3. An apparatus according to claim 2, including a drive motor mounted on said frame for rotating said first crank disk and said discharge roll simultaneously.

4. An apparatus according to claim 1, including an annular pipe guide supported by said distal end of said extension and through which said pipe guide loosely extends.

5. An apparatus according to claim 1, said guide pipe having an inside diameter larger than the width of the elongate materials.

6. An apparatus for piling up elongate materials, comprising;

(a) an internal gear positively rotatably mounted on a shaft;

(b) a turntable positively rotatably mounted on said shaft in concentric relation to said internal gear;

(c) an external gear rotatably mounted on said turntable and held in mesh with said internal gear;

(d) at least one first guide bar;

(e) a second guide bar slidably mounted on said first guide bar in substantially perpendicular relation thereto;

(f) a slider slidably mounted on said second guide bar and pivotably connected to said external gear in eccentric relation thereto;

(g) a discharge roll for discharging the elongate materials; and (h) a guide rod secured to said slider and supporting a guide pipe below said discharge roll for piling up the elongate materials in composite circular motions when said internal gear and said turntable are rotated.

7. An apparatus according to claim 6, said guide pipe having an inside diameter larger than the width of the elongate materials.

8. An apparatus for piling up elongate materials, comprising:

(a) a shaft having an internal gear positively rotatably mounted thereon;

(b) a sun gear positively rotatably mounted on said shaft in concentric relation to said internal gear;
(c) a planet gear held in mesh with said internal gear and said sun gear;
(d) at least one first guide bar;
(e) a second guide bar perpendicular to said first guide bar; bar
(f) a first slider secured to said second guide and slidably mounted on said first guide bar;
(g) a second slider slidably mounted on said second guide bar and pivotably connected to said planet gear in eccentric relation thereto;
(h) a discharge roll for discharging the elongate materials; and
(i) a guide rod secured to said slider and supporting a guide pipe below said discharge roll for piling up the elongate materials in composite circular motions when said internal gear ans said sun gear are rotated.

9. An apparatus according to claim 8, including a fixed guide disk having an annular slot, said planet gear having a central pin slidably received in said annular slot.

10. An apparatus according to claim 8, said guide pipe having an inside diameter larger than the width of the elongate materials.

11. A method of piling up elongate materials, comprising the steps of:

(a) feeding the elongate materials successively through a discharge roll while keeping the elongate materials facing in one direction;
(b) supplying the elongate materials in successive first substantially circular paths onto a stationary surface while simultaneously maintaining the elongate materials facing in said one direction during said supplying; and
(c) simultaneously shifting successive ones of said first substantially circular paths along a second circular path for thereby piling up the elongated materials successively in combined circular motions on said stationary surface.

12. A method of piling up elongate materials, comprising the steps of:

(a) supplying the elongate materials in successive first substantially circular paths onto a stationary surface at a first speed;
(b) simultaneously shifting successive ones of said first substantially circular paths along a second circular path at a second speed, the ratio of said first speed to said second speed being a non-integer, for thereby piling up the elongate materials successively in combined circular motions on said stationary surface.

13. A method according to claim 12, the ratio of said first speed to said second speed being 11.4:1.

* * * * *